US009127380B2

(12) United States Patent
Iwashita

(10) Patent No.: US 9,127,380 B2
(45) Date of Patent: Sep. 8, 2015

(54) WATER-REPELLENT WOVEN FABRIC AND GARMENT

(75) Inventor: Kenji Iwashita, Osaka (JP)

(73) Assignee: TEIJIN FRONTIER CO., LTD., Osaka (JP)

( * ) Notice: Subject to any disclaimer, the term of this patent is extended or adjusted under 35 U.S.C. 154(b) by 92 days.

(21) Appl. No.: 13/989,521

(22) PCT Filed: Nov. 21, 2011

(86) PCT No.: PCT/JP2011/076818

§ 371 (c)(1),
(2), (4) Date: May 24, 2013

(87) PCT Pub. No.: WO2012/077488

PCT Pub. Date: Jun. 14, 2012

(65) Prior Publication Data

US 2013/0239289 A1 Sep. 19, 2013

(30) Foreign Application Priority Data

Dec. 7, 2010 (JP) ..... 2010-272672

(51) Int. Cl.

| | |
|---|---|
| ***D03D 15/00*** | (2006.01) |
| ***D02G 1/02*** | (2006.01) |
| ***D06M 15/277*** | (2006.01) |
| ***A41D 1/00*** | (2006.01) |
| ***D06M 15/19*** | (2006.01) |

(52) U.S. Cl.

CPC ..... *D03D 15/0077* (2013.01); *A41D 1/00* (2013.01); *D02G 1/02* (2013.01); *D03D 15/0061* (2013.01); *D06M 15/195* (2013.01); *D06M 15/277* (2013.01); *D10B 2401/021* (2013.01); *D10B 2501/00* (2013.01); *Y10T 442/2008* (2015.04)

(58) Field of Classification Search

USPC ..... 428/79, 82, 85, 86, 88; 442/59, 60, 79, 442/82, 85, 88, 189, 203, 218; 264/171.1, 264/172.19, 173.1

See application file for complete search history.

(56) References Cited

U.S. PATENT DOCUMENTS 4,548,848 A 10/1985 Shibata et al.

FOREIGN PATENT DOCUMENTS

| | | | | |
|---|---|---|---|---|
| JP | 59-211649 | A | | 11/1984 |
| JP | 60-94645 | A | | 5/1985 |
| JP | 61-70043 | A | | 4/1986 |
| JP | 2004-339654 | A | | 12/2004 |
| JP | 2007-247089 | A | | 9/2007 |
| JP | 2007247096 | A | * | 9/2007 |
| JP | 2007-332482 | A | | 12/2007 |
| JP | 2009-138287 | A | | 6/2009 |
| JP | 2009138287 | A | * | 6/2009 |
| JP | 2010-133052 | A | | 6/2010 |
| WO | 2011-048888 | A1 | | 4/2011 |

OTHER PUBLICATIONS

International Search Report of PCT/JP2011/076818, dated Feb. 14, 2012.

* cited by examiner

*Primary Examiner* — Matthew Matzek
(74) *Attorney, Agent, or Firm* — Sughrue Mion, PLLC

(57) ABSTRACT

A water-repellent woven fabric having excellent water repellency, which is friendly to the environment, and a garment made of the water-repellent woven fabric are provided. A composite yarn containing a false-twist crimped textured yarn having an S-direction torque and a false-twist crimped textured yarn having a Z-direction torque is arranged for a warp or a weft to obtain a fabric, and a fluorine-based water repellent having a total concentration of perfluorooctanoic acid and perfluorooctanesulfonic acid of 0 to 5 ng/g is then adhered to the woven fabric.

15 Claims, No Drawings

WATER-REPELLENT WOVEN FABRIC AND GARMENT

CROSS REFERENCE TO RELATED APPLICATIONS

This application is a National Stage of International Application No. PCT/JP2011/076818 filed Nov. 21, 2011 (claiming priority based on Japanese Patent Application No. 2010-272672 filed Dec. 7, 2010), the contents of which are incorporated herein by reference in their entirety.

TECHNICAL FIELD

The present invention relates to a water-repellent woven fabric having excellent water repellency, which is a water-repellent woven fabric friendly to the environment, and to a garment made of the water-repellent woven fabric.

BACKGROUND ART

Hitherto, cloths having water repellency have been demanded in the fields of sports garment, casual garment, umbrella cloth, and the like, and it is performed to adhere a fluorine-based water repellent or the like to a cloth (see, for example, Patent Documents 1 and 2).

In addition, in recent years, for the purpose of taking the environment into consideration, it has been proposed to adhere a fluorine-based water repellent with a low content of a compound having possibility to affect living things (for example, perfluorooctanoic acid, perfluorooctanesulfonic acid, etc.) to a cloth (see, for example, Patent Document 3).

Patent Document 1: JP-A-60-94645
Patent Document 2: JP-A-61-70043
Patent Document 3: JP-A-2007-247089

SUMMARY OF THE INVENTION

Problem to be Solved by the Invention

The present inventor found that though the cloth having adhered thereto a fluorine-based water repellent with a low content of perfluorooctanoic acid (hereinafter also referred to as "PFOA") or perfluorooctanesulfonic acid (hereinafter also referred to as "PFOS") is a cloth which is friendly to the environment, it is not sufficient in terms of water repellency. Under such circumstances, the present invention has been made, and an object thereof is to provide a water-repellent woven fabric having excellent water repellency, which is a water-repellent woven fabric friendly to the environment, and a garment made of the water-repellent woven fabric.

Means for Solving the Problem

In order to achieve the foregoing object, the present inventor made extensive and intensive investigations. As a result, it has been found that at the time of giving a fluorine-based water repellent having a low content of PFOA, PFOS, or the like to a cloth, when a woven fabric in which a composite yarn containing a false-twist crimped textured yarn having an S-direction torque and a false-twist crimped textured yarn having a Z-direction torque is arranged for at least one of a warp and a weft is used as a cloth, lotus-leaf-like fine irregularities are formed on the surface of the woven fabric, whereby excellent water repellency is obtained. Then, the present inventor further made extensive and intensive investigations, leading to accomplishment of the present invention.

Thus, according to the present invention, a "water-repellent woven fabric having adhered thereto a fluorine-based water repellent having a total concentration of perfluorooctanoic acid and perfluorooctanesulfonic acid of 0 to 5 ng/g, wherein the woven fabric contains a composite yarn containing a false-twist crimped textured yarn having an S-direction torque and a false-twist crimped textured yarn having a Z-direction torque" is provided.

On that occasion, it is preferable that fibers constituting the composite yarn have a single yarn fineness of not more than 1 dtex. In addition, it is preferable that the composite yarn has a number of filaments of 50 or more. In addition, it is preferable that the composite yarn has a crimp degree of 13% or more. In addition, it is preferable that the composite yarn is subjected to interlacing processing at a number of interlaces of 35 to 90 per meter. In addition, it is preferable that the woven fabric has a cover factor ranging from 1,500 to 2,800. In addition, it is preferable that the woven fabric is subjected to calendar processing. In addition, it is preferable that lotus-leaf-like fine irregularities are formed on the surface of the woven fabric. In addition, it is preferable that the woven fabric has a bulkiness, as measured in conformity with JIS L 1018, of 1.30 or more. In addition, it is preferable that the woven fabric has a water-repellent rolling angle of not more than 22°.

In addition, according to the present invention, a garment made of the above-described water-repellent woven fabric is provided.

Effect of the Invention

According to the present invention, a water-repellent woven fabric having excellent water repellency, which is a water-repellent woven fabric friendly to the environment, and a garment made of the water-repellent woven fabric are provided.

BEST MODES FOR CARRYING OUT THE INVENTION

Embodiments of the present invention are hereunder described in detail.

First of all, a fluorine-based water repellent having a total concentration of perfluorooctanoic acid (PFOA) and perfluorooctanesulfonic acid (PFOS) of 0 to 5 ng/g (nanogram/gram) (namely, a total sum of the concentration of PFOA and the concentration of PFOS contained in one gram of the water repellent) adheres to the water-repellent woven fabric according to the present invention.

Here, when measured with a high-performance liquid chromatograph-mass analyzer (LC-MS), the total concentration of PFOA and PFOS is not more than 5 ng/g per gram of the water repellent (preferably less than 1 ng/g; more preferably, the concentration of at least one of PFOA and PFOS is 0 ng/g; and especially preferably, both of the concentration of PFOA and the concentration of PFOS are 0 ng/g). The case where the total concentration of PFOA and PFOS is more than 5 ng/g is not preferable in view of the environment.

As the fluorine-based water repellent having a total concentration of PFOA and PFOS of 0 to 5 ng/g (nanogram/gram), there are exemplified perfluoroalkyl acrylate copolymers constituted of only N-methylol group-free monomers, commercially available products, and the like. As the commercially available products, there are preferably exemplified ASAHI GUARD E-SERIES AG-E061 that is a fluorine-based water-repellent and oil-repellent agent, manufactured by Asahi Glass Co., Ltd.; SCOTCH GUARD PM3622, PM490, and PM930, manufactured by Sumitomo 3M Limited; and the like.

The water-repellent woven fabric according to the present invention contains a composite yarn containing a false-twist crimped textured yarn having an S-direction torque and a false-twist crimped textured yarn having a Z-direction torque. Since such a composite yarn is contained in the woven fabric, lotus-leaf-like fine irregularities are formed on the surface of the woven fabric, and hence, excellent water repellency is obtained.

Here, as conditions of the false-twist crimping processing, there are exemplified a method in which a yarn is allowed to go through a first roll and a heat treatment heater set up at a temperature of 90 to 220° C. (more preferably 100 to 190° C.) and then twisted by a twisting apparatus; and a method in which after the above-described twisting, the yarn is introduced into a second heater zone according to the need, thereby performing a relaxation heat treatment. A draw ratio at the time of false twisting processing preferably ranges from 0.8 to 1.5. In addition, in the equation of a false twisting number $(T/m)=(32500/\sqrt{Dtex})\times\alpha$, $\alpha$ is preferably 0.5 to 1.5. $\alpha$ is especially preferably 0.8 to 1.2. As the twisting apparatus which is used, a disk-type or belt-type friction twisting apparatus is preferable because it facilitates threading and scarcely causes yarn breakage. The twisting apparatus may also be a pin-type twisting apparatus.

In addition, when the composite yarn is a yarn obtained by doubling a false-twist crimped textured yarn having an S-direction torque and a false-twist crimped textured yarn having a Z-direction torque and then subjecting to interlacing processing (entangling treatment) at a number of interlaces of 35 to 90 per meter (more preferably 40 to 80 per meter), lotus-leaf-like fine irregularities are liable to be formed on the surface of the obtained woven fabric, and as a result, excellent water repellency is liable to be obtained. Thus, such a composite yarn is preferable. Furthermore, the composite yarn which is subjected to interlacing processing in such a way is preferable because the resulting woven fabric is also excellent in weaving performance. Incidentally, the interlacing processing (entangling treatment) may also be processing of achieving the treatment with a usual interlace nozzle.

In addition, as for the composite yarn, the torque is preferably small as far as possible, and non-torque (0 T/m) is the most preferable. In order to achieve such non-torque, at the time of combining a false-twist crimped textured yarn having an S-direction torque and a false-twist crimped textured yarn having a Z-direction torque, it may be suitable to use two kinds of false-twist crimped textured yarns having the same torque, except for having a different torque direction from each other.

In addition, the composite yarn which has a crimp degree of 13% or more (more preferably 13 to 25%) is preferable because lotus-leaf-like fine irregularities are liable to be formed on the surface of the woven fabric, so that excellent water repellency is obtained. When the crimp degree is less than 13%, there is a concern that sufficient water repellency is not obtained.

In view of forming lotus-leaf-like fine irregularities on the surface of the woven fabric, it is preferable that the composite yarn has a single yarn fineness of not more than 1 dtex (more preferably 0.001 to 1.0 dtex, still more preferably 0.1 to 1.0 dtex, and especially preferably 0.1 to 0.4 dtex). The composite yarn may also be a superfine fiber having a single fiber diameter of not more than 1 μm, which is called a nanofiber. When the single yarn fineness is more than 1 dtex, there is a concern that sufficient water repellency is not obtained.

In addition, it is preferable that the composite yarn has an overall fineness ranging from 33 to 220 dtex. Furthermore, the composite yarn which has a number of filaments of 50 or more (more preferably 50 to 10,000, and especially preferably 50 to 300) is preferable in view of obtaining excellent water repellency.

In view of obtaining excellent water repellency, the fiber constituting the composite yarn is preferably a polyester-based fiber made of a polyester. As such a polyester, there are exemplified polyesters composed of, as a main acid component, terephthalic acid and, as a main glycol component, an alkylene glycol having a carbon number of 2 to 6, namely at least one glycol selected from the group consisting of ethylene glycol, trimethylene glycol, tetramethylene glycol, pentamethylene glycol, and hexamethylene glycol, and especially preferably ethylene glycol.

Such a polyester may have a small amount (usually not more than 30% by mole) of a copolymerization component according to the need. On that occasion, as a bifunctional carboxylic acid other than terephthalic acid, for example, there can be exemplified aromatic, aliphatic or alicyclic bifunctional carboxylic acids such as isophthalic acid, naphthalenedicarboxylic acid, diphenyldicarboxylic acid, diphenoxyethanedicarboxylic acid, β-hydroxyethoxybenzoic acid, p-hydroxybenzoic acid, 5-sodium sulfoisophthalic acid, adipic acid, sebacic acid, and 1,4-cyclohexanedicarboxylic acid. In addition, as a diol compound other than the above-described glycols, for example, there can be exemplified aliphatic, alicyclic or aromatic diol compounds such as cyclohexanone-1,4-dimethanol, neopentyl glycol, bisphenol A, and bisphenol S, polyoxyalkylene glycols, and the like.

The polyester may be one synthesized by an arbitrary method. For example, when the case of polyethylene terephthalate is explained, it may be a product produced by a first-stage reaction of forming a glycol ester of terephthalic acid and/or a low polymer thereof by subjecting terephthalic acid and ethylene glycol to direct esterification reaction, subjecting a lower alkyl ester of terephthalic acid such as dimethyl terephthalate and ethylene glycol to ester exchange reaction, or allowing terephthalic acid and ethylene oxide to react with each other; and a second-stage reaction of heating a first-stage reaction product under reduced pressure to achieve a polycondensation reaction until a desired degree of polymerization is attained. In addition, the polyester may also be a polyester having been subjected to material recycling or chemical recycling. Furthermore, the polyester may also be an aliphatic polyester such as polylactic acid, stereo complex polylactic acid, etc.

The polyester may contain one or more kinds of a matting agent (titanium dioxide), a micropore forming agent (organic sulfonic acid metal salt), a coloration preventing agent, a heat stabilizer, a flame retardant (diantimony trioxide), a fluorescent brightener, a coloring pigment, an antistatic agent (sulfonic acid metal salt), a moisture absorbent (polyoxyalkylene glycol), an antibacterial agent, and other inorganic particles according to the need.

In the woven fabric according to the present invention, the composite yarn is arranged in at least one of a warp and a weft (preferably a warp and a weft). Here, it is preferable that the composite yarn is contained in an amount of 70% by weight or more (especially preferably 100% by weight) relative to the whole weight of the woven fabric. Incidentally, it is important that the present invention has a woven fabric structure. The case of a knitted fabric is not preferable because there is a concern that excellent water repellency is not obtained.

The water-repellent woven fabric according to the present invention can be, for example, produced by the following method. First of all, a composite yarn is obtained using a false-twist crimped textured yarn having an S-direction torque and a false-twist crimped textured yarn having a Z-direction torque. On that occasion, the complex method may be any of air entanglement such as interlacing processing, TASLAN (registered trademark) processing, etc., combined false twisting, doubling and twisting, covering, and the like. Above all, in view of forming lotus-leaf-like fine irregularities on the surface of the woven fabric to obtain water repellency, as described above, the interlacing processing (entangling treatment) is preferable.

Subsequently, a woven fabric is woven using the composite yarn. On that occasion, the structure of the woven fabric is not particularly limited. Examples thereof include three foundation weaves such as plain weave, twill weave, satin weave, etc., derivative weave, partial backed weaves such as warp backed weave, weft backed weave, etc., warp velvet, and the like. As for the number of layers, a monolayer is acceptable, or a multilayer of two or more layers is also acceptable. In addition, the weaving method may be a usual weaving method using a usual weaving machine (for example, a usual water-jet loom, an air-jet loom, a rapier loom, etc.).

Subsequently, the woven fabric is subjected to water-repellent processing. Here, as described above, a fluorine-based water repellent having a total concentration of perfluorooctanoic acid (PFOA) and perfluorooctanesulfonic acid (PFOS) of 0 to 5 ng/g (preferably 0 ng/g) per gram of the water repellent is used. It is preferable that if desired, an antistatic agent, a melamine resin, and a catalyst are mixed to form a processing agent having a concentration of the water repellent of about 3 to 15% by weight, and the surface of the woven fabric is treated with the processing agent at a pick-up rate of about 50 to 90%. As a method of treating the surface of the woven fabric with a processing agent, there are exemplified a pad method, a spray method, and the like. Above all, in view of permeating the processing agent into the inside of the woven fabric, the pad method is preferable. The above-described pick-up rate means a weight proportion (%) of the processing agent relative to the weight of the woven fabric (before giving the processing agent).

Incidentally, as for the antistatic agent, polyethylene glycol group-containing polyester-based resins, polyethylene glycol group-containing urethane-based resins, reaction products between a polyethylene glycol group-containing polycation-based compound and diglycidyl ether, and the like are preferable. Antistatic compounds inclusive of anionic surfactants such as higher alcohol sulfuric acid ester salts, sulfated oils, sulfonic acid salts, phosphoric acid ester salts, etc.; cationic surfactants such as amine salt types, quaternary ammonium salts, imidazoline type quaternary salts, etc.; nonionic surfactants such as polyethylene glycol types, polyhydric alcohol ester types, etc.; ampholytic surfactants such as imidazoline type quaternary salts, alanine types, betaine types, etc.; and the like are also acceptable.

It is preferable to perform the heat treatment for polymerization of monomers by at least one treatment of a dry heat treatment and a wet heat treatment preferably under conditions at a temperature of 50 to 180° C. for 0.1 to 30 minutes. The heat treatment may also be a vapor heat treatment. In such a vapor heat treatment, a saturated steam or a superheated steam at 80 to 160° C. is preferably used. On that occasion, the treatment time preferably ranges from several seconds to several tens of minutes. After performing such a vapor heat treatment, water washing or warm water washing, or reductive washing may be performed according to the need.

In addition, the woven fabric which is subjected to calendar processing in at least one step of a pre-step and a post-step of the water-repellent processing step is preferable because the surface of the woven fabric is liable to become lotus-leaf-like, thereby obtaining excellent water repellency. On that occasion, as for conditions of the calendaring processing, the temperature is preferably 130° C. or higher (more preferably 140 to 195° C.), and the linear pressure preferably ranges from 200 to 20,000 N/cm (more preferably from 200 to 1,000 N/cm).

In addition, in at least one step of a pre-step and a post-step of the water-repellent processing step, customary dyeing processing, caustic reduction processing, or napping processing may also be performed. Furthermore, an ultraviolet ray shielding agent, an antibacterial agent, a deodorant, an insecticide, a phosphorescent agent, a retroreflecting agent, a minus ion generating agent, and the like may be added and applied.

In such a woven fabric, a covering factor CF of the woven fabric as defined according to the following equation which ranges from 1,500 to 2,800 is preferable because more excellent water repellency is obtained.

$$CF=(DWp/1.1)^{1/2}\times MWp+(DWf/1.1)^{1/2}\times MWf$$

In the equation, DWp is an overall fineness (dtex) of a warp; MWp is a weaving density (number/2.54 cm) of a warp; DWf is an overall fineness (dtex) of a weft; and MWf is a weaving density (number/2.54 cm) of a weft.

In addition, in such a woven fabric, the woven fabric which has a bulkiness, as measured in conformity with JIS L 1018, of 1.30 or more (more preferably 1.50 to 2.00) is preferable because more excellent water repellency is obtained.

Since the fluorine-based water repellent having a total concentration of perfluorooctanoic acid and perfluorooctanesulfonic acid of 0 to 5 ng/g adheres to the thus obtained water-repellent woven fabric, the water-repellent woven fabric becomes a woven fabric which is friendly to the environment. In addition, at the same time, since the composite yarn is contained in the woven fabric, lotus-leaf-like fine irregularities are formed on the surface of the water-repellent woven fabric. Then, since a minute air layer is formed by the lotus-leaf-like fine irregularities, when a water droplet is placed on the surface of the woven fabric, excellent water repellency is exhibited. Incidentally, such an effect is sometimes called a lotus effect.

On that occasion, as for the water repellency, it is preferable that the woven fabric has a water-repellent rolling angle of not more than 25° (more preferably not more than 22°, and especially preferably 5 to 22°).

However, the water-repellent rolling angle means an angle at the time when 0.2 cc of water is gently dropped on a planar sample to be measured, which is installed on a horizontal plate, this planar plate is gently inclined at a uniform rate, and the water droplet starts to roll.

Next, the garment according to the present invention is a garment made of the above-described woven fabric. Since the garment according to the present invention is made of the above-described woven fabric, it is a garment which is friendly to the environment and has excellent water repellency. Incidentally, such a garment includes down garments, badminton shirts, running shirts, soccer pants, tennis pants, basketball pants, table tennis pants, badminton pants, running pants, golf pants, undershirts for various sports, inner wears for various sports, sweaters, T-shirts, jerseys, sweat suits, windbreakers, jackets, and the like.

Incidentally, since the above-described woven fabric is a woven fabric which is friendly to the environment and has excellent water repellency, it is suitably used for not only garments but umbrella cloth, raincoat cloth, shoe, hat, quilting, quilt cover, and the like.

EXAMPLES

Next, Example and Comparative Example are described in details, but it should not be construed that the present invention is limited thereto. Incidentally, respective measurement items in the Examples were measured in the following methods.

(1) Torque:

A sample (crimped yarn) of about 70 cm was transversely stretched, an initial load of 0.18 mN×display tex (2 mg/de) was hung in the center thereof, and the both ends were then doubled.

Though the yarn started to rotate, the yarn was kept as it was until the initial load rested, thereby obtaining a twisted yarn. The thus obtained twisted yarn was measured for a number of twists in a length of 25 cm under a load of 17.64 mN×display tex (0.2 g/de) with a twist tester. The obtained number of twists (T/25 cm) was quadrupled to calculate a torque (T/m).

(2) Number of Interlaces (Entanglements):

An entangled yarn was taken in a length of 1 m under a load of 8.82 mN×display tex (0.1 g/de), and after removing the load, a number of nodes after allowing to stand for shrink release at room temperature for 24 hours was read and expressed in terms of "number per meter".

(3) Crimp Degree:

A test yarn was wound around a cloth inspection machine having a perimeter of 1.125 m, thereby preparing a skein having a dry fineness of 3,333 dtex. The skein was suspended by a hanging nail of a scale plate, an initial load of 6 g was added in a lower portion thereof, and a load of 600 g was further added. At that time, a length L0 of the skein was measured. Immediately thereafter, the load was removed from the skein, and the resulting skein was removed from the handing nail of the scale plate and dipped in boiling water for 30 minutes, thereby revealing crimping. The skein after the treatment with boiling water was taken out from the boiling water, and the moisture contained in the skein was absorbed and removed with a filter paper, followed by air-drying at room temperature for 24 hours. The air-dried skein was suspended by a handing nail of a scale plate, and a load of 600 g was applied in a lower portion thereof. One minute thereafter, a length L1a of the skein was measured, and thereafter, the load was removed from the skein. One minute thereafter, a length L2a of the skein was measured. A crimp degree (CP) of the test filament yarn was calculated according to the following equation.

$$CP(\%)=((L1a-L2a)/L0)\times 100$$

(4) Stretchability:

Stretchability (%) was measured in accordance with the method B of JIS L 1096.

(4) Thickness of Woven Fabric:

A thickness (mm) of a woven fabric was measured in conformity with JIS L 1096.

(5) Weight Per Unit of Woven Fabric:

A weight per unit (g/m$^2$) of a woven fabric was measured in conformity with JIS L 1096.

(6) Bulkiness of Woven Fabric:

Bulkiness of a woven fabric was measured in conformity with JIS L 1018.

(7) Cover Factor:

A cover factor CF of a woven fabric was calculated according to the following equation.

$$CF=(DWp/1.1)^{1/2}\times MWp+(DWf/1.1)^{1/2}\times MWf$$

In the equation, DWp is an overall fineness (dtex) of a warp; MWp is a weaving density (number/2.54 cm) of a warp; DWf is an overall fineness (dtex) of a weft; and MWf is a weaving density (number/2.54 cm) of a weft.

(8) Water Repellency (Water-Repellent Rolling Angle):

An angle at the time when 0.2 cc of water was gently dropped on a planar sample to be measured, which was installed on a horizontal plate, this planar plate was gently inclined at a uniform rate, and the water droplet started to roll, was defined as a water-repellent rolling angle. Incidentally, the smaller the water-repellent rolling angle is, the more favorable the water repellency is. The case where water-repellent rolling angle is not more than 25° is considered to be tolerable.

(9) Concentrations of PFOA and PFOS:

Concentrations of PFOA and PFOS were measured under the following conditions and expressed in terms of "ng/g".

Apparatus: LS-MS/MS tandem type mass analyzer, TSQ-7000 (Thermo Electron Co., Ltd.)

High-performance liquid chromatograph, LC-10Avp (Shimadzu Corporation)

Column: Capcellpak C8 100 mm×2 mmi.d. (5 μm)

Moving layer: A; 0.5 mmoles/L ammonium acetate, B; acetonitrile

Flow rate: 0.2 mL/min

Sample injection amount: 3 μL

CP temperature: 220° C.

Ionization voltage: 4.5 kV

Ion multiplier voltage: 1,300 V

Ionization method: ESI-Negative

Example 1

Polyethylene terephthalate was subjected to melt spinning at 280° C. using a usual spinning apparatus, taken off at a rate of 2,800 m/min, and then wound up without being drawn, thereby obtaining a semi-drawn polyethylene terephthalate yarn of 56 dtex/36 fil.

Subsequently, the polyethylene terephthalate yarn was subjected to simultaneous drawing false-twist crimping processing under conditions at a draw ratio of 1.6 times, a number of false-twists of 2,500 T/m (in the S-direction), a heater temperature of 180° C., and a yarn speed of 350 m/min.

In addition, the polyethylene terephthalate yarn was subjected to simultaneous drawing false-twist crimping processing under conditions at a draw ratio of 1.6 times, a number of false-twists of 2,500 T/m (in the Z-direction), a heater temperature of 180° C., and a yarn speed of 350 m/min.

Subsequently, the false-twist crimped textured yarn having an S-direction torque and the false-twist crimped textured yarn having a Z-direction torque were combined and subjected to interlacing processing (entangling treatment) to obtain a composite yarn (66 dtex/72 fil, crimp degree: 16%, torque: 0 T/m). The interfacing processing was performed using an interlace nozzle, and 50 interlaces (entanglements) per meter were given at an overfeed rate of 1.0% and a compressed air pressure of 0.3 MPa (3 kgf/cm$^2$).

Subsequently, the composite yarn was arranged for a warp and a weft, and a woven fabric having a plain structure (woven fabric composed of only the composite yarn) was woven using a usual water-jet loom weaving machine.

Subsequently, the woven fabric was subjected to scouring with open width at 95° C. using a U-sofcer and then subjected to a relaxation treatment at a temperature of 120° C. using a jet dyeing machine. Subsequently, the woven fabric was subjected to intermediate setting at a temperature of 190° C. using a tenter. Subsequently, the resulting woven fabric was subjected to dyeing processing with a disperse dye at a temperature of 130° C. using a jet dyeing machine and then subjected to the following water-repellent processing.

The water-repellent processing was performed by using a processing agent as described below, undergoing liquid squeezing at a pick-up rate of 80%, drying at 130° C. for 3 minutes, and then performing a heat treatment at 170° C. for 45 seconds.

<Composition of Processing Agent>

Fluorine-based water repellent: 8.0 wt %

(ASAHI GUARD E-SERIES AG-E061, manufactured by Asahi Glass Co., Ltd., PFOA: less than 1 ng/g, PFOS: less than 1 ng/g)

Melamine resin: 0.3 wt %

(SUMITEX RESIN M-3, manufactured by Sumitomo Chemical Co., Ltd.)

Catalyst: 0.3 wt %

(SUMITEX ACCELERATOR ACX, manufactured by Sumitomo Chemical Co., Ltd.)

Water: 91.4 wt %

Subsequently, the woven fabric was subjected to final setting at a temperature of 170° C. using a tenter. Then, the woven fabric was subjected to calendar processing at a roll temperature of 150° C. and a linear pressure of 300 N/cm, thereby obtaining a water-repellent woven fabric.

The thus obtained water-repellent woven fabric had a thickness of 0.15 mm, a weight per unit of 92 g/m$^2$, a bulkiness of 1.67, a warp density of 132/2.54 cm, a weft density of 112/2.54 cm, a cover factor of 1,890, a weft stretchability of 7%, and a rolling angle of 18°. Lotus-leaf-like fine irregularities were formed on the surface of the water-repellent woven fabric, and the water-repellent woven fabric had excellent water repellency. In addition, since the water repellent adhered to the water-repellent woven fabric, the water-repellent woven fabric was a woven fabric which was friendly to the environment.

A windbreaker (sports garment) was sewn using such a water-repellent woven fabric, and a tester wore the windbreaker. As a result, the windbreaker was excellent in the water repellency.

Comparative Example 1

The same procedures as those in Example 1 were followed, except that in Example 1, a false-twist crimped textured yarn made of polyethylene terephthalate (56 dtex/72 fil, crimp degree: 14%, torque: 45 T/m) was arranged as a single yarn for a warp and a weft without being formed into a composite yarn.

The obtained water-repellent woven fabric had a thickness of 0.09 mm, a weight per unit of 75 g/m$^2$, a bulkiness of 1.16, a warp density of 148/2.54 cm, a weft density of 120/2.54 cm, a cover factor of 1,900, a weft stretchability of 4%, and a rolling angle of 26°. Though the water-repellent woven fabric was a woven fabric which was friendly to the environment, it was inferior in the water repellency.

In addition, a windbreaker (sports garment) was sewn using such a water-repellent woven fabric, and a tester wore the windbreaker. As a result, the windbreaker was inferior in the water repellency.

INDUSTRIAL APPLICABILITY

According to the present invention, a water-repellent woven fabric having excellent water repellency, which is friendly to the environment, and a garment made of the water-repellent woven fabric are obtained, and its industrial value is extremely large.

The invention claimed is:

1. A water-repellent woven fabric having adhered thereto a fluorine-based water repellent having a total concentration of perfluorooctanoic acid and perfluorooctanesulfonic acid of 0 to 5 ng/g, wherein the woven fabric is subjected to calendar processing and contains a composite yarn containing a false-twist crimped textured yarn having a S-direction torque and a false-twist crimped textured yarn having a Z-direction torque, and lotus-leaf-like fine irregularities are formed on the surface of the woven fabric.

2. The water-repellent woven fabric according to claim 1, wherein fibers constituting the composite yarn have a single yarn fineness of not more than 1 dtex.

3. The water-repellent woven fabric according to claim 1, wherein the composite yarn has a number of filaments of 50 or more.

4. The water-repellent woven fabric according to claim 1, wherein the composite yarn has a crimp degree of 13% or more.

5. The water-repellent woven fabric according to claim 1, wherein the composite yarn is subjected to interlacing processing at a number of interlaces of 35 to 90 per meter.

6. The water-repellent woven fabric according to claim 1, wherein the woven fabric has a cover factor ranging from 1,500 to 2,800.

7. The water-repellent woven fabric according to claim 1, wherein the woven fabric has a bulkiness, as measured in conformity with JIS L 1018, of 1.30 or more.

8. The water-repellent woven fabric according to claim 1, wherein the woven fabric has a water-repellent rolling angle of not more than 22°.

9. A garment made of the water-repellent woven fabric according to claim 1.

10. A garment made of the water-repellent woven fabric according to claim 2.

11. A garment made of the water-repellent woven fabric according to claim 3.

12. A garment made of the water-repellent woven fabric according to claim 4.

13. A garment made of the water-repellent woven fabric according to claim 5.

14. A garment made of the water-repellent woven fabric according to claim 6.

15. A garment made of the water-repellent woven fabric according to claim 7.

* * * * *